US009489892B2

(12) United States Patent
Lee et al.

(10) Patent No.: US 9,489,892 B2
(45) Date of Patent: Nov. 8, 2016

(54) METHOD OF GENERATING GAMMA CORRECTION CURVES, GAMMA CORRECTION UNIT, AND ORGANIC LIGHT EMITTING DISPLAY DEVICE HAVING THE SAME

(71) Applicants: Baek-Woon Lee, Yongin (KR); Sang-Myeon Han, Yongin (KR)

(72) Inventors: Baek-Woon Lee, Yongin (KR); Sang-Myeon Han, Yongin (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 611 days.

(21) Appl. No.: 13/950,760

(22) Filed: Jul. 25, 2013

(65) Prior Publication Data

US 2014/0063079 A1 Mar. 6, 2014

(30) Foreign Application Priority Data

Aug. 31, 2012 (KR) ..... 10-2012-0096126

(51) Int. Cl.

*G09G 3/32* (2016.01)
*G09G 3/20* (2006.01)
*G09G 5/02* (2006.01)

(52) U.S. Cl.

CPC ..... *G09G 3/3258* (2013.01); *G09G 3/2003* (2013.01); *G09G 3/3225* (2013.01); *G09G 3/3233* (2013.01); *G09G 5/02* (2013.01); *G09G 2300/0861* (2013.01); *G09G 2320/0285* (2013.01); *G09G 2320/0673* (2013.01); *G09G 2360/16* (2013.01)

(58) Field of Classification Search

CPC ..... G09G 5/02–5/06; G09G 3/30–3/3291; G09G 2320/0673

See application file for complete search history.

(56) References Cited

U.S. PATENT DOCUMENTS

2006/0001624 A1 1/2006 Lee
2007/0085911 A1* 4/2007 Nakamura ..... H04N 9/735 348/223.1
2009/0195484 A1* 8/2009 Lee ..... G09G 3/3216 345/76
2011/0025586 A1 2/2011 Lee
2011/0025671 A1 2/2011 Lee

FOREIGN PATENT DOCUMENTS

KR 10-0646996 B1 11/2006
KR 10-2011-0013692 A 2/2011
KR 10-2011-0013693 A 2/2011

* cited by examiner

*Primary Examiner* — David Tung
(74) *Attorney, Agent, or Firm* — Lee & Morse, P.C.

(57) ABSTRACT

A method of gamma correction for an organic light emitting display device includes calculating a high-power voltage to be supplied in an emission period of the organic light emitting display device based on a gray-level range of an input image data for each frame, generating a gamma correction curve for the calculated high-power voltage based on a predetermined minimum gamma correction curve and a predetermined maximum gamma correction curve, performing a gamma correction on image data based on the gamma correction curve to generate gamma-corrected image data, and displaying the gamma-corrected image data on the organic light emitting display device.

16 Claims, 8 Drawing Sheets

METHOD OF GENERATING GAMMA CORRECTION CURVES, GAMMA CORRECTION UNIT, AND ORGANIC LIGHT EMITTING DISPLAY DEVICE HAVING THE SAME

CROSS-REFERENCE TO RELATED APPLICATION

This application claims priority under 35 USC §119 to Korean Patent Application No. 10-2012-0096126, filed on Aug. 31, 2012 in the Korean Intellectual Property Office (KIPO), the contents of which are incorporated herein in its entirety by reference.

BACKGROUND

1. Field

Embodiments relate to a method of generating gamma correction curves, a gamma correction unit, and an organic light emitting display device having the same.

2. Description of the Related Art

An organic light emitting display device is widely used as a display device of electronic devices. Generally, a driving technique of the organic light emitting display device may be classified into a sequential emission driving technique and a simultaneous emission driving technique. In the sequential emission driving technique, a scan operation is sequentially performed for pixels constituting respective horizontal-lines based on a scan signal, and then an emission operation is sequentially performed for the pixels constituting respective horizontal-lines based on an emission signal. In the simultaneous emission driving technique, a scan operation is sequentially performed for the pixels constituting respective horizontal-lines based on the scan signal, and then an emission operation is simultaneously performed for all pixels of a pixel unit (i.e., a display panel).

SUMMARY

Embodiments are directed to a method of gamma correction for an organic light emitting display device, the method including calculating a high-power voltage to be supplied in an emission period of the organic light emitting display device based on a gray-level range of an input image data for each frame, generating a gamma correction curve for the calculated high-power voltage based on a predetermined minimum gamma correction curve and a predetermined maximum gamma correction curve, performing a gamma correction on image data based on the gamma correction curve to generate gamma-corrected image data, and displaying the gamma-corrected image data on the organic light emitting display device.

The input image data may include a red color data, a green color data, and a blue color data, and the calculated high-power voltage may be determined based on a greatest maximum gray-level among a maximum gray-level of the red color data, a maximum gray-level of the green color data, and a maximum gray-level of the blue color data.

Gamma correction values of the gamma correction curve may decrease as the calculated high-power voltage increases, and the gamma correction values of the gamma correction curve may increase as the calculated high-power voltage decreases.

The gamma correction curve may correspond to the predetermined minimum gamma correction curve when the calculated high-power voltage corresponds to a predetermined maximum high-power voltage, and the gamma correction curve may correspond to the predetermined maximum gamma correction curve when the calculated high-power voltage corresponds to a predetermined minimum high-power voltage.

Generating the gamma correction curve may include providing gamma correction values of the predetermined minimum gamma correction curve, providing gamma correction values of the predetermined maximum gamma correction curve, and calculating gamma correction values of the gamma correction curve by performing an interpolation based on the gamma correction values of the predetermined minimum gamma correction curve and the gamma correction values of the predetermined maximum gamma correction curve.

The gamma correction values of the gamma correction curve may be calculated by performing an interpolation related to voltages, and then by performing an interpolation related to gray-levels.

The interpolation may correspond to a linear interpolation or a non-linear interpolation.

Embodiments are also directed to a gamma correction unit, including a pre-processing block configured to generate a pre-processing image data by performing a pre-processing on an input image data for each frame, a gamma correction curve generating block configured to generate a gamma correction curve for a calculated high-power voltage based on a predetermined minimum gamma correction curve and a predetermined maximum gamma correction curve, the calculated high-power voltage being supplied in an emission period of an organic light emitting display device and being calculated based on a gray-level range of the input image data, and a post-processing block configured to generate a post-processing image data to be displayed on a display panel by performing a gamma correction on the pre-processing image data based on the gamma correction curve.

The input image data may include a red color data, a green color data, and a blue color data, and the calculated high-power voltage may be determined based on a greatest maximum gray-level among a maximum gray-level of the red color data, a maximum gray-level of the green color data, and a maximum gray-level of the blue color data.

Gamma correction values of the gamma correction curve may decrease as the calculated high-power voltage increases, and the gamma correction values of the gamma correction curve may increase as the calculated high-power voltage decreases.

The gamma correction curve may correspond to the predetermined minimum gamma correction curve when the calculated high-power voltage corresponds to a predetermined maximum high-power voltage, and the gamma correction curve may correspond to the predetermined maximum gamma correction curve when the calculated high-power voltage corresponds to a predetermined minimum high-power voltage.

The gamma correction curve generating block may include a look-up table configured to store gamma correction values of the predetermined minimum gamma correction curve and gamma correction values of the predetermined maximum gamma correction curve, a voltage interpolation block configured to perform an interpolation related to voltages based on the gamma correction values of the predetermined minimum gamma correction curve and the gamma correction values of the predetermined maximum gamma correction curve, and a gray-level interpolation block configured to perform an interpolation related to gray-levels based on the gamma correction values of the predetermined minimum gamma correction curve and the gamma correction values of the predetermined maximum gamma correction curve.

At least one of the interpolation performed by the voltage interpolation block and the interpolation performed by the gray-level interpolation block may correspond to a linear interpolation or a non-linear interpolation.

Embodiments are also directed to an organic light emitting display device, including a pixel unit having a plurality of pixel circuits, a scan driving unit configured to provide a scan signal to the pixel circuits, a data driving unit configured to provide a data signal to the pixel circuits, a control signal generating unit configured to provide an emission control signal to the pixel circuits, a high-power voltage calculation unit configured to calculate a high-power voltage to be supplied in an emission period based on a gray-level range of an input image data for each frame, a gamma correction unit configured to generate a gamma correction curve for the calculated high-power voltage based on a predetermined minimum gamma correction curve and a predetermined maximum gamma correction curve, and to provide a post-processing image data corresponding to the data signal based on the gamma correction curve to the data driving unit, a power unit configured to provide the calculated high-power voltage and a low-power voltage to the pixel circuits, and a timing control unit configured to control the scan driving unit, the data driving unit, the control signal generating unit, the high-power voltage calculation unit, the gamma correction unit, and the power unit.

The high-power voltage calculation unit and the gamma correction unit may be implemented within the timing control unit.

The gamma correction unit may include a pre-processing block configured to generate a pre-processing image data by performing a pre-processing on the input image data for each frame, a gamma correction curve generating block configured to generate the gamma correction curve by performing an interpolation based on the predetermined minimum gamma correction curve and the predetermined maximum gamma correction curve, and a post-processing block configured to generate the post-processing image data by performing a gamma correction on the pre-processing image data based on the gamma correction curve.

The input image data may include a red color data, a green color data, and a blue color data, and the calculated high-power voltage may be determined based on a greatest maximum gray-level among a maximum gray-level of the red color data, a maximum gray-level of the green color data, and a maximum gray-level of the blue color data.

Gamma correction values of the gamma correction curve may decrease as the calculated high-power voltage increases, and the gamma correction values of the gamma correction curve may increase as the calculated high-power voltage decreases.

The gamma correction curve may correspond to the predetermined minimum gamma correction curve when the calculated high-power voltage corresponds to a predetermined maximum high-power voltage, and the gamma correction curve may correspond to the predetermined maximum gamma correction curve when the calculated high-power voltage corresponds to a predetermined minimum high-power voltage.

The gamma correction curve generating block may include a look-up table configured to store gamma correction values of the predetermined minimum gamma correction curve and gamma correction values of the predetermined maximum gamma correction curve, a voltage interpolation block configured to perform an interpolation related to voltages based on the gamma correction values of the predetermined minimum gamma correction curve and the gamma correction values of the predetermined maximum gamma correction curve, and a gray-level interpolation block configured to perform an interpolation related to gray-levels based on the gamma correction values of the predetermined minimum gamma correction curve and the gamma correction values of the predetermined maximum gamma correction curve.

BRIEF DESCRIPTION OF THE DRAWINGS

Illustrative, non-limiting example embodiments will be more clearly understood from the following detailed description taken in conjunction with the accompanying drawings.

DETAILED DESCRIPTION

Figure 1:
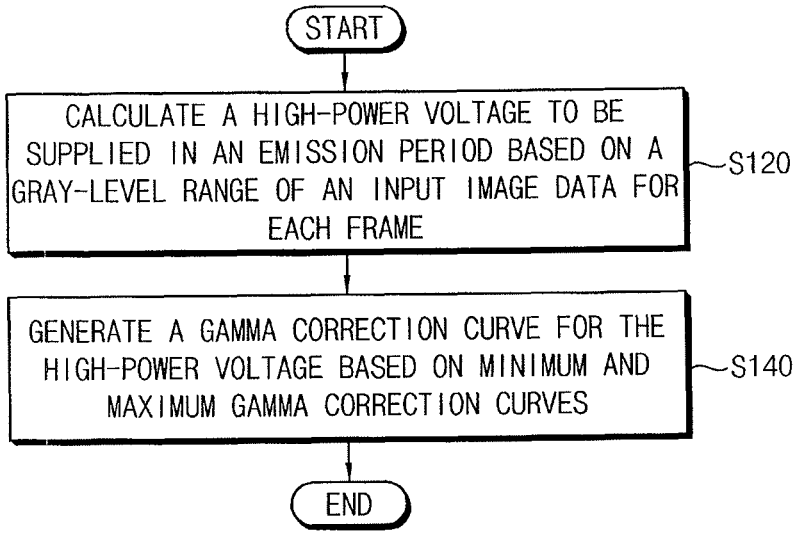
FIG. 1 is a flow chart illustrating a method of generating gamma correction curves according to example embodiments.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third, etc. may be used herein to describe various elements, these elements should not be limited by these terms. These terms are used to distinguish one element from another. Thus, a first element discussed below could be termed a second element. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
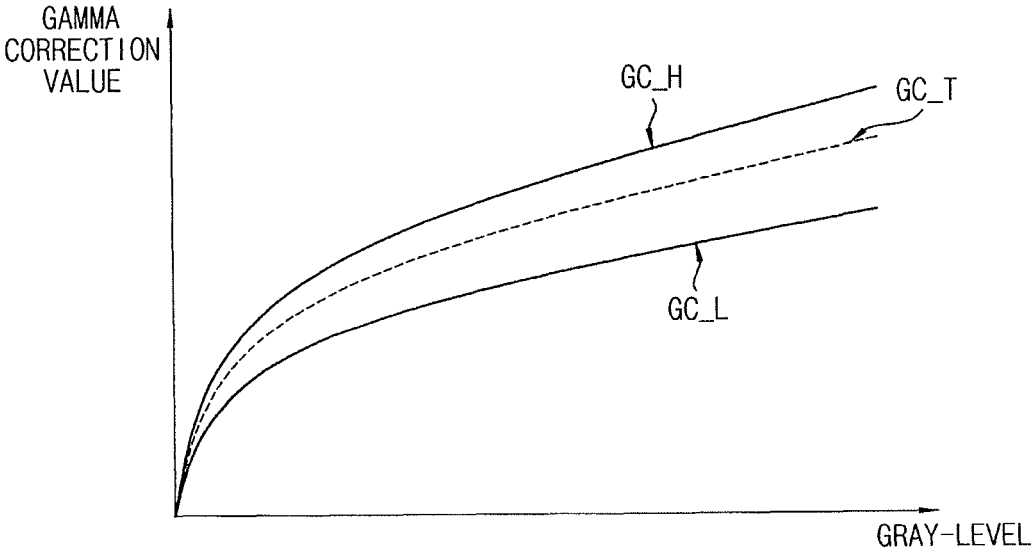
FIG. 2 is a diagram illustrating a gamma correction curve that is generated by a method of FIG. 1.

FIG. 1 is a flow chart illustrating a method of generating gamma correction curves according to example embodiments. FIG. 2 is a diagram illustrating a gamma correction curve that is generated by a method of FIG. 1.

Referring to FIGS. 1 and 2, the method of FIG. 1 may calculate a high-power voltage to be supplied in an emission period of an organic light emitting display device based on a gray-level range of an input image data for each frame (operation S120), and may generate a gamma correction curve GC_T for the calculated high-power voltage based on a predetermined minimum gamma correction curve GC_L and a predetermined maximum gamma correction curve GC_H (operation S140).

According to an example embodiment, a frame operation period of an organic light emitting display device may employ a simultaneous emission driving technique that may include an initialization period, a reset period, a threshold voltage compensation period, a scan period, and an emission period. The simultaneous emission driving technique cyclically changes power voltages (i.e., voltage levels of the power voltages ELVDD and ELVSS) according to the frame operation period (i.e., the initialization period, the reset period, the threshold voltage compensation period, the scan period, and the emission period). In addition, the simultaneous emission driving technique may change the high-power voltage (i.e., ELVDD) supplied in the emission period based on a maximum value (i.e., a maximum gray-level) of an input image data that is applied for each frame in order to reduce power consumption. For example, the simultaneous emission driving technique may decrease the high-power voltage supplied in the emission period for a dark color frame. For example, the simultaneous emission driving technique may detect a gray-level range of the input image data, may decrease the high-power voltage of the emission period if the gray-level range is relatively narrow, and may increase the high-power voltage of the emission period if the gray-level range is relatively wide. For example, assuming that a total gray-level range of the input image data is between 0 and 255, and that a maximum voltage of the high-power voltage is 15V, the high-power voltage of 10V may be supplied in the emission period if the gray-level range of the input image data is between 0 and 140, and the high-power voltage of 15V may be supplied in the emission period if the gray-level range of the input image data is between 0 and 255. However, since a phenomenon in which a color of an input image becomes yellowish occurs (i.e., color changes of the input image is caused) if the high-power voltage of the emission period greatly decreases, the method of FIG. 1 may help increase a change margin of the high-power voltage supplied in the emission period by generating a gamma correction curve GC_T by reflecting changes of the high-power voltage when the high-power voltage of the emission period is changed. Hereinafter, the method of FIG. 1 will be described in further detail.

The method of FIG. 1 may calculate the high-power voltage to be supplied in the emission period of the organic light emitting display device based on the gray-level range of the input image data for each frame (operation S120). Here, the input image data may include a red color data (R), a green color data (G), and a blue color data (B). The calculated high-power voltage may be determined based on the greatest maximum gray-level among a maximum gray-level of the red color data, a maximum gray-level of the green color data, and a maximum gray-level of the blue color data. In an example embodiment, the calculated high-power voltage may be obtained by a high-power voltage calculation unit of the organic light emitting display device that includes a maximum gray-level detection block, a maximum voltage calculation block, and a maximum voltage determination block. For example, the maximum gray-level detection block may detect the red color data having the maximum gray-level, the green color data having the maximum gray-level, and the blue color data having the maximum gray-level for each frame. Subsequently, the maximum voltage calculation block may calculate a red color high-power voltage corresponding to the red color data having the maximum gray-level, may calculate a green color high-power voltage corresponding to the green color data having the maximum gray-level, and may calculate a blue color high-power voltage corresponding to the blue color data having the maximum gray-level. Next, the maximum voltage determination block may determine the calculated high-power voltage as the greatest high-power voltage among the red color high-power voltage, the green color high-power voltage, and the blue color high-power voltage.

The method of FIG. 1 may generate the gamma correction curve GC_T for the calculated high-power voltage based on the predetermined minimum gamma correction curve GC_L and the predetermined maximum gamma correction curve GC_H (operation S140). Here, the gamma correction curve GC_T may be generated by performing an interpolation on the predetermined minimum gamma correction curve GC_L and the predetermined maximum gamma correction curve GC_H. The interpolation may be a linear interpolation or a non-linear interpolation. For convenience of description, the linear interpolation is described. The predetermined minimum gamma correction curve GC_L may be provided by measuring a gamma correction curve for any relatively high high-power voltage in a change range of the high-power voltage to be supplied in the emission period of the organic light emitting display device. The predetermined maximum gamma correction curve GC_H may be provided by measuring a gamma correction curve for any relatively low high-power voltage in a change range of the high-power voltage to be supplied in the emission period of the organic light emitting display device. On the other hand, except for the predetermined maximum gamma correction curve GC_H and the predetermined minimum gamma correction curve GC_L, any gamma correction curve GC_T may be generated by performing an interpolation on the predetermined maximum gamma correction curve GC_H and the predetermined minimum gamma correction curve GC_L. As a result, gamma correction values of the gamma correction curve GC_T may decrease as the calculated high-power voltage increases, and the gamma correction values of the gamma correction curve GC_T may increase as the calculated high-power voltage decreases.

In an example embodiment, the predetermined maximum gamma correction curve GC_H may be provided by measuring a gamma correction curve for a predetermined minimum high-power voltage to be supplied in the emission period of the organic light emitting display device, and the predetermined minimum gamma correction curve GC_L may be provided by measuring a gamma correction curve for a predetermined maximum high-power voltage to be supplied in the emission period of the organic light emitting display device. Thus, when the calculated high-power voltage corresponds to the predetermined maximum high-power voltage, the gamma correction curve GC_T may correspond to the predetermined minimum gamma correction curve GC_L. In addition, when the calculated high-power voltage corresponds to the predetermined minimum high-power voltage, the gamma correction curve GC_T may correspond to the predetermined maximum gamma correction curve GC_H. The method of FIG. 1 may determine the predetermined minimum gamma correction curve GC_L as the gamma correction curve GC_T without performing an interpolation if the calculated high-power voltage corresponds to the predetermined maximum high-power voltage. Similarly, the method of FIG. 1 may determine the predetermined maximum gamma correction curve GC_H as the gamma correction curve GC_T without performing an interpolation if the calculated high-power voltage corresponds to the predetermined minimum high-power voltage.

As described above, the method of FIG. 1 may generate the gamma correction curve GC_T by performing an interpolation on the predetermined minimum gamma correction curve GC_L and the predetermined maximum gamma correction curve GC_H. For example, when the method of FIG. 1 generates the gamma correction curve GC_T for the calculated high-power voltage based on the predetermined minimum gamma correction curve GC_L and the predetermined maximum gamma correction curve GC_H, the method of FIG. 1 may calculate the gamma correction values of the gamma correction curve GC_T by providing the gamma correction values of the predetermined minimum gamma correction curve GC_L, by providing the gamma correction values of the predetermined maximum gamma correction curve GC_H, and then by performing an interpolation based on the gamma correction values of the predetermined minimum gamma correction curve GC_L and the gamma correction values of the predetermined maximum gamma correction curve GC_H. The predetermined minimum gamma correction curve GC_L and the predetermined maximum gamma correction curve GC_H may be stored in a look-up table (LUT). However, since a size of the look-up table has limits, the gamma correction values of the predetermined minimum gamma correction curve GC_L and the gamma correction values of the predetermined maximum gamma correction curve GC_H may be stored in the look-up table.

For example, assuming that the predetermined minimum gamma correction curve GC_L and the predetermined maximum gamma correction curve GC_H represent 1024 gray-levels (e.g., a gray-level range is between 0 and 1023), 64 levels (i.e., 6 bits) of the predetermined minimum gamma correction curve GC_L and 64 levels (i.e., 6 bits) of the predetermined maximum gamma correction curve GC_H may be stored in the look-up table. In this case, the gamma correction values of the predetermined minimum gamma correction curve GC_L may be stored at an interval of 16 gray-levels (i.e., 1024/64=16) in the look-up table, and the gamma correction values of the predetermined maximum gamma correction curve GC_H may also be stored at an interval of 16 gray-levels (i.e., 1024/64=16) in the look-up table. Thus, when the gamma correction values of the predetermined minimum gamma correction curve GC_L and the gamma correction values of the predetermined maximum gamma correction curve GC_H are provided from the look-up table, the gamma correction values of the gamma correction curve GC_T may be calculated by performing an interpolation based on the gamma correction values of the predetermined minimum gamma correction curve GC_L and the gamma correction values of the predetermined maximum gamma correction curve GC_H. Therefore, when the method of FIG. 1 generates the gamma correction curve GC_T for the calculated high-power voltage based on the predetermined minimum gamma correction curve GC_L and the predetermined maximum gamma correction curve GC_H, the method of FIG. 1 performs an interpolation related to voltages and an interpolation related to gray-levels based on the gamma correction values of the predetermined minimum gamma correction curve GC_L and the gamma correction values of the predetermined maximum gamma correction curve GC_H. Here, the gamma correction values of the gamma correction curve GC_T may be calculated by performing an interpolation related to voltages, and then by performing an interpolation related to gray-levels.

Figure 3:
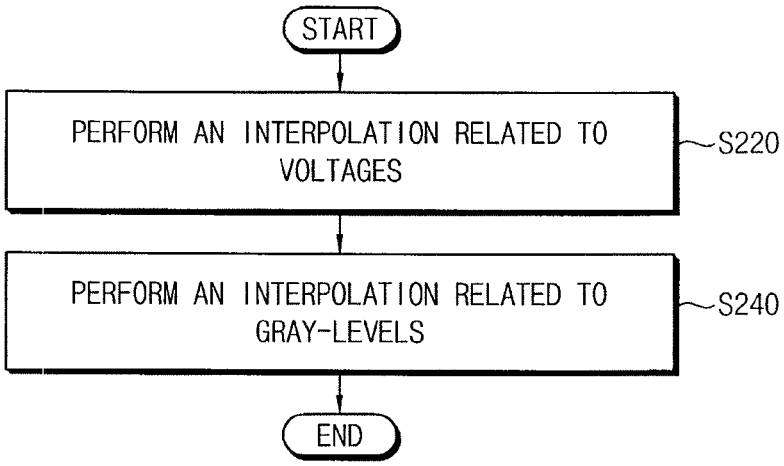
FIG. 3 is a flow chart illustrating an example in which an interpolation is performed by a method of FIG. 1.
Figure 4:
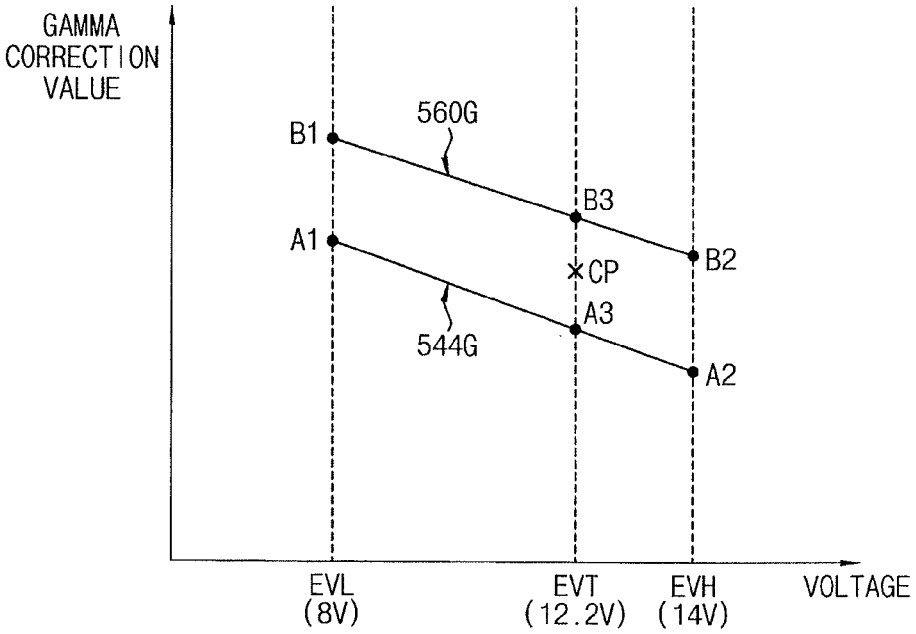
FIG. 4 is a diagram illustrating an example in which an interpolation is performed by a method of FIG. 1.

FIG. 3 is a flow chart illustrating an example in which an interpolation is performed by a method of FIG. 1. FIG. 4 is a diagram illustrating an example in which an interpolation is performed by a method of FIG. 1.

Referring to FIGS. 3 and 4, when the method of FIG. 1 calculates the gamma correction values of the gamma correction curve GC_T, the method of FIG. 1 may perform an interpolation related to voltages based on the gamma correction values of the predetermined minimum gamma correction curve GC_L and the gamma correction values of the predetermined maximum gamma correction curve GC_H (operation S220), and then may perform an interpolation related to gray-levels based on the gamma correction values of the predetermined minimum gamma correction curve GC_L and the gamma correction values of the predetermined maximum gamma correction curve GC_H (operation S240).

Hereinafter, an example in which the gamma correction values of the gamma correction curve GC_T are calculated will be described with reference to FIG. 4. As illustrated in FIG. 4, the high-power voltage EVT (e.g., 12.2V) to be supplied in the emission period of the organic light emitting display device may be calculated based on a gray-level range of the input image data. Subsequently, a gamma correction value of a target gray-level (e.g., a 553.375 (or, 553+3/8) gray-level) of a pre-processing image data that is generated by performing a pre-processing on the input image data may be calculated by the method of FIG. 1. Here, it is assumed that the predetermined minimum gamma correction curve GC_L and the predetermined maximum gamma correction curve GC_H represent 1024 gray-levels, and that the gamma correction values of the predetermined minimum gamma correction curve GC_L and the gamma correction values of the predetermined maximum gamma correction curve GC_H are stored at an interval of 16 gray-levels in the look-up table. In addition, it is assumed that the predetermined minimum gamma correction curve GC_L corresponds to a gamma correction curve for any relatively high high-power voltage (hereinafter, a second high-power voltage EVH) (e.g., 14V) in a change range of the high-power voltage EVT to be supplied in the emission period of the organic light emitting display device, and that the predetermined maximum gamma correction curve GC_H corresponds to a gamma correction curve for any relatively low high-power voltage (hereinafter, a first high-power voltage EVL) (e.g., 8V) in a change range of the high-power voltage EVT to be supplied in the emission period of the organic light emitting display device.

For example, since the gamma correction values of the predetermined minimum gamma correction curve GC_L are provided at an interval of 16 gray-levels, and the gamma correction values of the maximum gamma correction curve GC_H are provided at an interval of 16 gray-levels, adjacent gray-levels close to the target gray-level (e.g., a 553.375 gray-level) may be a 544 gray-level and a 560 gray-level. Here, a gamma correction value for the 544 gray-level of the predetermined maximum gamma correction curve GC_H may correspond to a first point A1, and a gamma correction value for the 560 gray-level of the predetermined maximum gamma correction curve GC_H may correspond to a second point B1. Similarly, a gamma correction value for the 544 gray-level of the predetermined minimum gamma correction curve GC_L may correspond to a third point A2, and a gamma correction value for the 560 gray-level of the predetermined minimum gamma correction curve GC_L may correspond to a fourth point B2. Thus, the method of FIG. 1 may perform an interpolation related to voltages based on the gamma correction values of the predetermined minimum gamma correction curve GC_L and the gamma correction values of the predetermined maximum gamma correction curve GC_H (operation S220). As illustrated in FIG. 4, a fifth point A3 corresponding to the gamma correction value related to the 544 gray-level and the calculated high-power voltage EVT (e.g., 12.2V) may be calculated by performing an interpolation on the first point A1 corresponding to the gamma correction value related to the 544 gray-level and the first high-power voltage EVL (e.g., 8V) and the third point A2 corresponding to the gamma correction value related to the 544 gray-level and the second high-power voltage EVH (e.g., 14V). Similarly, a sixth point B3 corresponding to the gamma correction value related to the 560 gray-level and the calculated high-power voltage EVT (e.g., 12.2V) may be calculated by performing an interpolation on the second point B1 corresponding to the gamma correction value related to the 560 gray-level and the first high-power voltage EVL (e.g., 8V) and the fourth point B2 corresponding to the gamma correction value related to the 560 gray-level and the second high-power voltage EVH (e.g., 14V).

After the fifth point A3 corresponding to the gamma correction value related to the 544 gray-level and the calculated high-power voltage EVT (e.g., 12.2V) and the sixth point B3 corresponding to the gamma correction value related to the 560 gray-level and the calculated high-power voltage EVT (e.g., 12.2V) are calculated, the method of FIG. 1 may perform an interpolation related to gray-levels on the fifth point A3 and the sixth point B3 (operation S240). As illustrated in FIG. 4, a final point CP corresponding to the gamma correction value related to the target gray-level (e.g., the 553.375 gray-level) and the calculated high-power voltage EVT (e.g., 12.2V) may be calculated by performing an interpolation on the fifth point A3 corresponding to the gamma correction value related to the 544 gray-level and the calculated high-power voltage EVT (e.g., 12.2V) and the sixth point B3 corresponding to the gamma correction value related to the 560 gray-level and the calculated high-power voltage EVT (e.g., 12.2V).

Although it is illustrated in FIG. 4 that the interpolation is a linear interpolation, the interpolation may be a non-linear interpolation.

As described above, the method of FIG. 1 may generate a gamma correction curve by reflecting changes of the high-power voltage EVT of the emission period of the organic light emitting display device employing the simultaneous emission driving technique. In addition, the method of FIG. 1 may help prevent the gray-level loss of the input image and may reduce a size of the look-up table by generating the gamma correction curve based on interpolations. As a result, an organic light emitting display device employing the method of FIG. 1 may help increase a change margin of the high-power voltage EVT supplied in the emission period by helping to prevent color changes of the input image due to changes of the high-power voltage EVT of the emission period when the high-power voltage EVT of the emission period is changed.

Figure 5:
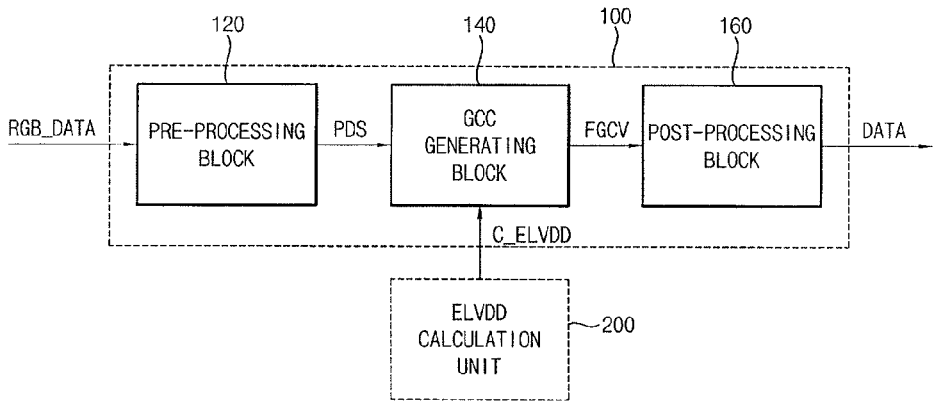
FIG. 5 is a block diagram illustrating a gamma correction unit according to example embodiments.

FIG. 5 is a block diagram illustrating a gamma correction unit 100 according to example embodiments.

Referring to FIG. 5, the gamma correction unit 100 may include a pre-processing block 120, a gamma correction curve generating block 140, and a post-processing block 160. As illustrated in FIG. 5, the gamma correction unit 100 may receive information C_ELVDD related to calculated high-power voltage from a high-power voltage calculation unit of an organic light emitting display device.

The pre-processing block 120 may generate a pre-processing image data PDS by performing a pre-processing (e.g., a data scaling, a noise reduction, etc.) on an input image data RGB_DATA for each frame. Here, the input image data RGB_DATA may include a red color data, a green color data, and a blue color data. The gamma correction curve generating block 140 may generate a gamma correction curve FGCV for the calculated high-power voltage based on a predetermined minimum gamma correction curve and a predetermined maximum gamma correction curve after a high-power voltage to be supplied in an emission period of the organic light emitting display device is calculated based on a gray-level range of the input image data RGB_DATA. Thus, the gamma correction curve generating block 140 may receive the information C_ELVDD related to the calculated high-power voltage provided from the high-power voltage calculation unit of the organic light emitting display device, and may generate the gamma correction curve FGCV for the calculated high-power voltage based on the predetermined minimum gamma correction curve and the predetermined maximum gamma correction curve.

As described above, the calculated high-power voltage may be determined based on the greatest maximum gray-level among a maximum gray-level of the red color data, a maximum gray-level of the green color data, and a maximum gray-level of the blue color data. The predetermined minimum gamma correction curve may be provided by measuring a gamma correction curve for any relatively high high-power voltage in a change range of the high-power voltage to be supplied in the emission period of the organic light emitting display device. The predetermined maximum gamma correction curve may be provided by measuring a gamma correction curve for any relatively low high-power voltage in a change range of the high-power voltage to be supplied in the emission period of the organic light emitting display device. Also, except for the predetermined maximum gamma correction curve and the predetermined minimum gamma correction curve, any gamma correction curve FGCV may be generated by performing an interpolation on the predetermined maximum gamma correction curve and the predetermined minimum gamma correction curve. As a result, gamma correction values of the gamma correction curve FGCV may decrease as the calculated high-power voltage increases, and the gamma correction values of the gamma correction curve FGCV may increase as the calculated high-power voltage decreases.

As described above, the gamma correction curve generating block 140 may generate the gamma correction curve FGCV by performing an interpolation on the predetermined minimum gamma correction curve and the predetermined maximum gamma correction curve. For this operation, the gamma correction curve generating block 140 may include a look-up table, a voltage interpolation block, and a gray-level interpolation block. The look-up table may store the gamma correction values of the predetermined minimum gamma correction curve and the gamma correction values of the predetermined maximum gamma correction curve. The voltage interpolation block may perform an interpolation related to voltages based on the gamma correction values of the predetermined minimum gamma correction curve and the gamma correction values of the predetermined maximum gamma correction curve. The gray-level interpolation block may perform an interpolation related to gray-levels based on the gamma correction values of the predetermined minimum gamma correction curve and the gamma correction values of the predetermined maximum gamma correction curve. Since a size of the look-up table has limits, the look-up table may store the gamma correction values of the predetermined minimum gamma correction curve and the gamma correction values of the predetermined maximum gamma correction curve, instead of the predetermined minimum gamma correction curve and the predetermined maximum gamma correction curve itself. The components (i.e., the look-up table, the voltage interpolation block, and the gray-level interpolation block) of the gamma correction curve generating block 140 will be described in detail with reference to FIG. 6. In some example embodiments, the gamma correction curve generating block 140 may perform a linear interpolation or a non-linear interpolation. Subsequently, the post-processing block 160 may generate a post-processing image data DATA, where the post-processing image data DATA is to be displayed on a display panel, by performing a gamma correction on the pre-processing image data PDS based on the gamma correction curve FGCV. Next, the post-processing image data DATA may be provided to the display panel (i.e., pixel unit) via a data driving unit of the organic light emitting display device.

Figure 6:
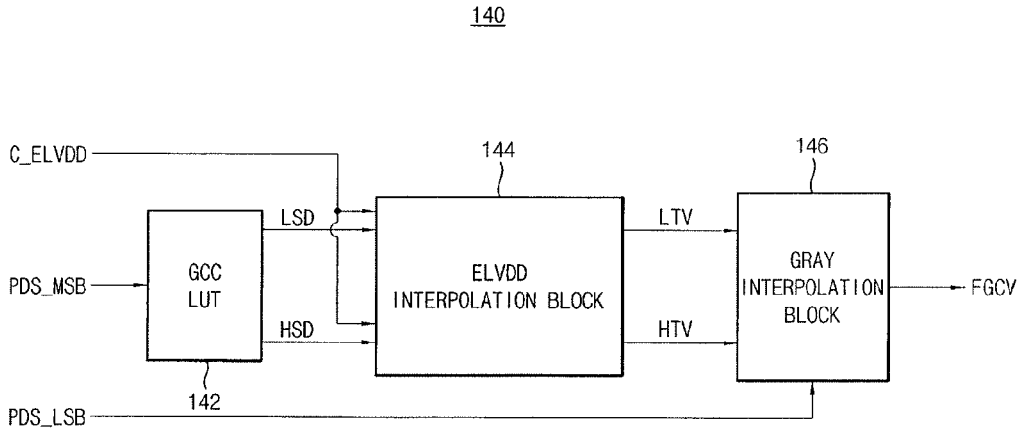
FIG. 6 is a block diagram illustrating a gamma correction curve generating block included in a gamma correction unit of FIG. 5.

FIG. 6 is a block diagram illustrating a gamma correction curve generating block included in a gamma correction unit of FIG. 5.

Referring to FIG. 6, the gamma correction curve generating block 140 may receive the information C_ELVDD related to the calculated high-power voltage, and may generate the gamma correction curve FGCV for the calculated high-power voltage based on the predetermined minimum gamma correction curve and the predetermined maximum gamma correction curve. For this operation, the gamma correction curve generating block 140 may include a look-up table 142, a voltage interpolation block 144, and a gray-level interpolation block 146.

The look-up table 142 may store the gamma correction values of the predetermined minimum gamma correction curve and the gamma correction values of the predetermined maximum gamma correction curve. As described above, since a size of the look-up table 142 has limits, the look-up table 142 may store the gamma correction values of the predetermined minimum gamma correction curve and the gamma correction values of the maximum gamma correction curve, instead of the predetermined minimum gamma correction curve and the maximum gamma correction curve itself. Thus, the look-up table 142 may receive only most significant bits (MSB) data PDS_MSB among the pre-processing image data PDS, and may output gamma correction values LSD of the predetermined minimum gamma correction curve and gamma correction values HSD of the predetermined maximum gamma correction curve to generate the gamma correction curve FGCV based on the MSB data PDS_MSB. Thus, least significant bits LSB data PDS_MSB may not be applied to the look-up table 142, whereas the MSB data PDS_MSB may be applied to the look-up table 142. Here, a quantity of bits of the MSB data PDS_MSB may be determined according to, e.g., a color accuracy. Subsequently, the voltage interpolation block 144 may perform an interpolation related to voltages based on the gamma correction values LSD of the predetermined minimum gamma correction curve and the gamma correction values HSD of the predetermined maximum gamma correction curve. Thus, the voltage interpolation block 144 may generate a first gamma correction value LTV for a first adjacent gray-level at the calculated high-power voltage, where the first adjacent gray-level is lower than a target gray-level, and a second gamma correction value HTV for a second adjacent gray-level at the calculated high-power voltage, where the second adjacent gray-level is higher than the target gray-level.

After the first gamma correction value LTV and the second gamma correction value HTV are generated based on the gamma correction values LSD of the predetermined minimum gamma correction curve and the gamma correction values HSD of the predetermined maximum gamma correction curve, the gray-level interpolation block 146 may perform an interpolation related to gray-levels on the first gamma correction value LTV and the second gamma correction value HTV. Here, since information related to the LSB data PDS_LSB of the pre-processing image data PDS is used, the gray-level interpolation block 146 may receive the LSB data PDS_LSB. The gray-level interpolation block 146 may generate the gamma correction curve FGCV for the calculated high-power voltage by performing an interpolation related to gray-levels on the first gamma correction value LTV and the second gamma correction value HTV.

As described above, the gamma correction curve generating block 140 may avoid truncation caused by limits of the size of the look-up table 142 for the pre-processing image data PDS when the gamma correction curve generating block 140 generates the gamma correction curve FGCV for the calculated high-power voltage. Thus, the gamma correction curve generating block 140 may reduce a size of look-up table 142, and may help prevent the gray-level loss of the input image. As a result, the gamma correction unit having the gamma correction curve generating block 140 may help prevent color changes of the input image due to changes of the high-power voltage of the emission period by performing the gamma correction based on the gamma correction curve generated by reflecting changes of the high-power voltage of the emission period when the high-power voltage of the emission period is changed in the organic light emitting display device employing a simultaneous emission driving technique.

Figure 7:
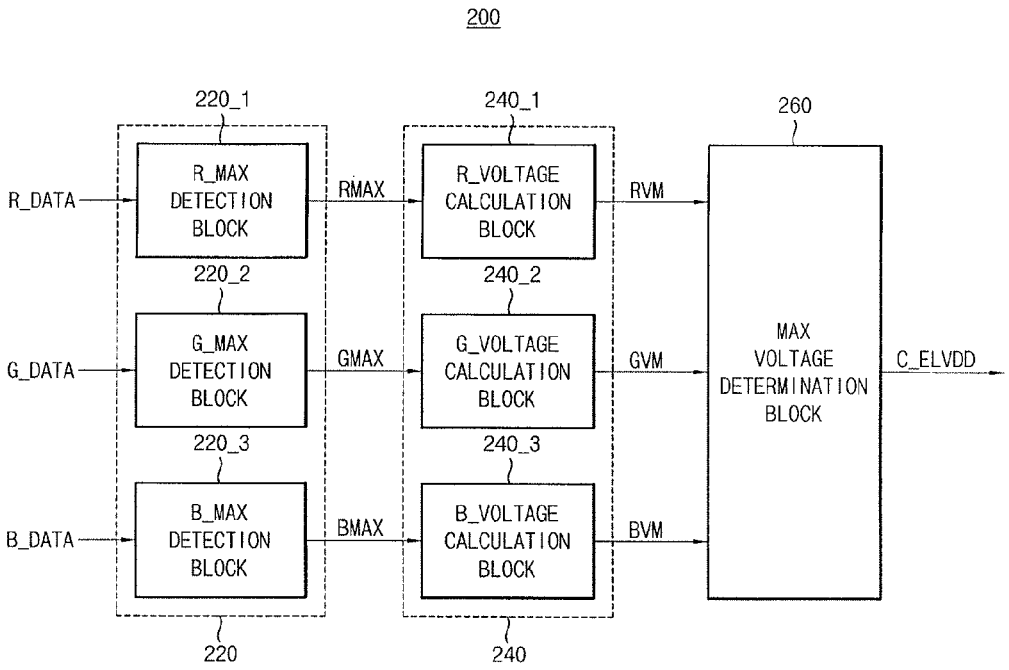
FIG. 7 is a block diagram illustrating a high-power voltage calculating unit that provides a gamma correction unit of FIG. 5 with information of a high-power voltage that is calculated for each frame.

FIG. 7 is a block diagram illustrating a high power voltage calculating unit that provides a gamma correction unit of FIG. 5 with information related to a high power voltage that is calculated for each frame.

Referring to FIG. 7, the high-power voltage calculation unit 200 may include a maximum gray-level detection block 220, a maximum voltage calculation block 240, and a maximum voltage determination block 260. The high-power voltage calculation unit 200 may provide the information C_ELVDD related to the high-power voltage of the emission period to the gamma correction unit 100 of FIG. 5. The maximum gray-level detection block 220 may include a red color maximum gray-level detection block 220_1, a green color maximum gray-level detection block 220_2, and a blue color maximum gray-level detection block 220_3. The maximum voltage calculation block 240 may include a red color maximum voltage calculation block 240_1, a green color maximum voltage calculation block 240_2, and a blue color maximum voltage calculation block 240_3.

The maximum gray-level detection block 220 may detect a maximum gray-level red color data RMAX, a maximum gray-level green color data GMAX, and a maximum gray-level blue color data BMAX for each frame. For example, the red color maximum gray-level detection block 220_1 may sequentially receive the red color data R_DATA for each frame, and may detect the maximum gray-level red color data RMAX, where the maximum gray-level red color data RMAX has the highest maximum gray-level among the red color data R_DATA in each frame, by comparing a current data with a previous data. The green color maximum gray-level detection block 220_2 may sequentially receive the green color data G_DATA for each frame, and may detect the maximum gray-level green color data GMAX, where the maximum gray-level green color data GMAX has the highest maximum gray-level among the green color data G_DATA in each frame, by comparing the current data with the previous data. The blue color maximum gray-level detection block 220_3 may sequentially receive the blue color data B_DATA for each frame, and may detect the maximum gray-level blue color data BMAX, where the maximum gray-level blue color data BMAX has the highest maximum gray-level among the blue color data B_DATA in each frame, by comparing the current data with the previous data.

Subsequently, the maximum voltage calculation block 240 may calculate a red color high-power voltage RVM corresponding to the maximum gray-level red color data RMAX, a green color high-power voltage GVM corresponding to the maximum gray-level green color data GMAX, and a blue color high-power voltage BVM corresponding to the maximum gray-level blue color data BMAX. For example, the red color maximum voltage calculation block 240_1 may receive the maximum gray-level red color data RMAX, and may output the red color high-power voltage RVM corresponding to the maximum gray-level red color data RMAX to the maximum voltage determination block 260. The green color maximum voltage calculation block 240_2 may receive the maximum gray-level green color data GMAX, and may output the green color high-power voltage GVM corresponding to the maximum gray-level green color data GMAX to the maximum voltage determination block 260. The blue color maximum voltage calculation block 240_3 may receive the maximum gray-level blue color data BMAX, and may output the blue color high-power voltage BVM corresponding to the maximum gray-level blue color data BMAX to the maximum voltage determination block 260.

Next, the maximum voltage determination block 260 may receive the red color high-power voltage RVM from the red color maximum voltage calculation block 240_1, the green color high-power voltage GVM from the green color maximum voltage calculation block 240_2, and the blue color high-power voltage BVM from the blue color maximum voltage calculation block 240_3, and may determine the greatest high-power voltage among the red color high-power voltage RVM, the green color high-power voltage GVM, and the blue color high-power voltage BVM as the high-power voltage of the emission period. Thus, the maximum voltage determination block 260 may provide the information C_ELVDD related to the high-power voltage of the emission period to the gamma correction unit 100 of FIG. 5. Since the maximum voltage determination block 260 may provide the information C_ELVDD related to the high-power voltage of the emission period to a power unit of the organic light emitting display device, the power unit may output a ground voltage or a fixed high-power voltage as the high-power voltage in the non-emission period of the organic light emitting display device, and may output a variable high-power voltage as the high-power voltage (i.e., referred to as the high-power voltage of the emission period) in the emission period of the organic light emitting display device.

Figure 8:
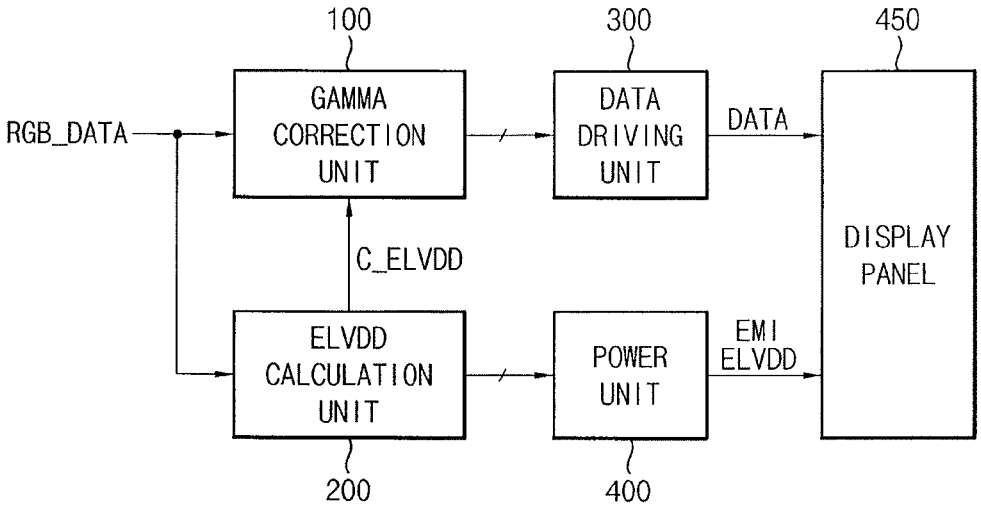
FIG. 8 is a schematic diagram illustrating an example in which a gamma correction is performed for each frame by a gamma correction unit of FIG. 5.

FIG. 8 is a schematic diagram illustrating an example in which a gamma correction is performed for each frame by a gamma correction unit of FIG. 5.

Referring to FIG. 8, it is illustrated that a gamma correction is performed for each frame by the gamma correction unit 100 of FIG. 5. As illustrated in FIG. 8, the high-power voltage calculation unit 200 may calculate a high-power voltage EMI_ELVDD to be supplied in an emission period of an organic light emitting display device based on a gray-level range of an input image data RGB_DATA for each frame, and may allow a power unit 400 to output the calculated high-power voltage EMI_ELVDD to a display panel 450 (i.e., a pixel unit) in the emission period of the organic light emitting display device. Here, the gamma correction unit 100 may receive the information C_ELVDD related to the calculated high-power voltage EMI_ELVDD from the high-power voltage calculation unit 200, and may generate a gamma correction curve for the calculated high-power voltage EMI_ELVDD based on a predetermined minimum gamma correction curve and a predetermined maximum gamma correction curve. Subsequently, the gamma correction unit 100 may generate and output a post-processing image data DATA corresponding to a data signal to be output to the display panel 450 based on the gamma correction curve. As a result, a data driving unit 300 of the organic light emitting display device may provide the data signal to the display panel 450.

As described above, the gamma correction unit 100 may help prevent color changes of an input image due to changes of the high-power voltage EMI_ELVDD of the emission period by performing a gamma correction based on the gamma correction curve generated by reflecting the changes of the high-power voltage EMI_ELVDD of the emission period when the high-power voltage EMI_ELVDD of the emission period is changed in the organic light emitting display device employing a simultaneous emission driving technique. In addition, the gamma correction unit 100 may help prevent the gray-level loss of the input image and may reduce a size of the look-up table by generating the gamma correction curve based on interpolations.

Figure 9:
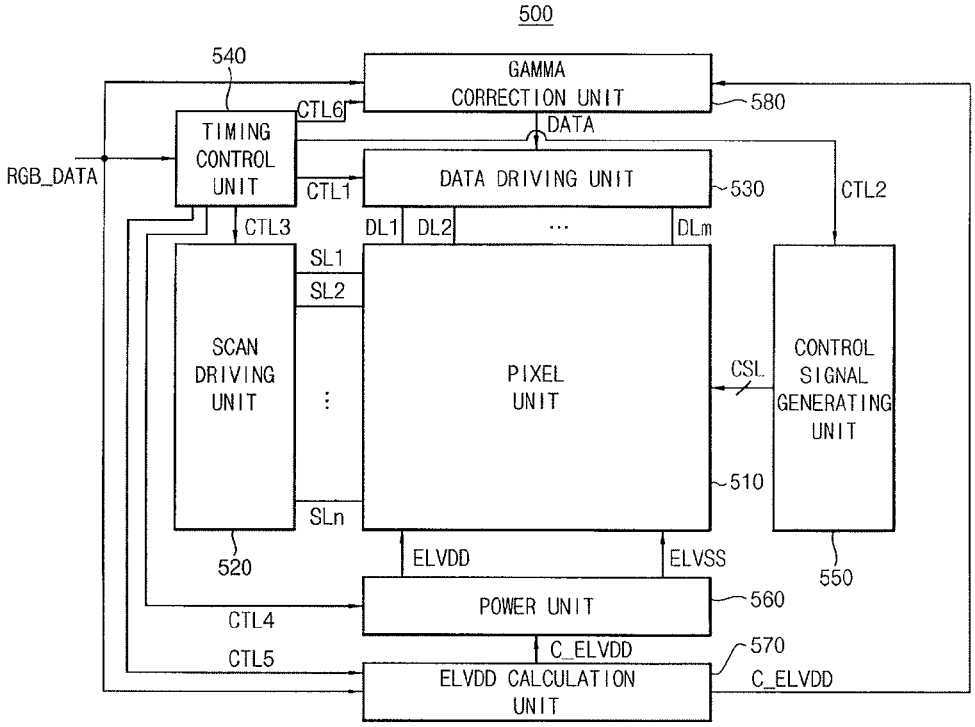
FIG. 9 is a block diagram illustrating an organic light emitting display device according to example embodiments.

FIG. 9 is a block diagram illustrating an organic light emitting display device according to example embodiments.

Referring to FIG. 9, the organic light emitting display device 500 may employ a simultaneous emission driving technique, and may include a pixel unit 510, a scan driving unit 520, a data driving unit 530, a timing control unit 540, a control signal generating unit 550, a power unit 560, a high-power voltage calculation unit 570, and a gamma correction unit 580. In an example embodiment, as illustrated in FIG. 9, the high-power voltage calculation unit 570 and the gamma correction unit 580 may be separately implemented from the timing control unit 540. In another example embodiment, the high-power voltage calculation unit 570 and the gamma correction unit 580 may be implemented within the timing control unit 540.

The pixel unit (i.e., display panel) 510 may include a plurality of pixel circuits. The pixel unit 510 may be coupled to the scan driving unit 520 via a plurality of scan-lines SL1 through SLn, may be coupled to the data driving unit 530 via a plurality of data-lines DL1 through DLm, and may be coupled to the control signal generating unit 550 via a plurality of control-lines. Since the pixel circuits are arranged at locations corresponding to crossing points of the scan-lines SL1 through SLn and the data-lines DL1 through DLm, the pixel unit 510 may include n*m pixel circuits. The scan driving unit 520 may provide a scan signal to the pixel circuits. The data driving unit 530 may provide a data signal to the pixel circuits. The control signal generating unit 550 may provide an emission control signal CSL to the pixel circuits.

The power unit 560 may provide a high-power voltage ELVDD and a low-power voltage ELVSS to the pixel circuits. The organic light emitting display device 500 may set the high-power voltage ELVDD of an emission period to be different from the high-power voltage ELVDD of a non-emission period. For example, a ground voltage or a fixed high-power voltage may be supplied as the high-power voltage ELVDD in the non-emission period of the organic light emitting display device 500, and a variable high-power voltage (i.e., referred to as the high-power voltage of the emission period) may be supplied as the high-power voltage ELVDD in the emission period of the organic light emitting display device 500. The high-power voltage calculation unit 570 may calculate the high-power voltage of the emission period based on a gray-level range of an input image data for each frame, and may provide information C_ELVDD related to the calculated high-power voltage to the power unit 560 and the gamma correction unit 580.

The gamma correction unit 580 may generate a gamma correction curve for the calculated high-power voltage based on a predetermined minimum gamma correction curve and a predetermined maximum gamma correction curve, and may provide a post-processing image data DATA corresponding to the data signal to the data driving unit 530 based on the gamma correction curve. As a result, the gamma correction unit 580 may help prevent color changes of an input image due to changes of the high-power voltage of the emission period by performing a gamma correction based on the gamma correction curve generated by reflecting the changes of the high-power voltage of the emission period when the high-power voltage of the emission period is changed. For this operation, the gamma correction unit 580 may include a pre-processing block, a gamma correction curve generating block, and a post-processing block. For example, the pre-processing block may generate a pre-processing image data by performing a pre-processing on the input image data for each frame. The gamma correction curve generating block may generate the gamma correction curve by performing an interpolation based on the predetermined minimum gamma correction curve and the predetermined maximum gamma correction curve. The post-processing block may generate the post-processing image data DATA by performing a gamma correction on the pre-processing image data based on the gamma correction curve.

The gamma correction curve generating block may include a look-up table, a voltage interpolation block, and a gray-level interpolation block. The look-up table may store gamma correction values of the predetermined minimum gamma correction curve and gamma correction values of the predetermined maximum gamma correction curve. The voltage interpolation block may perform an interpolation related to voltages based on the gamma correction values of the predetermined minimum gamma correction curve and the gamma correction values of the predetermined maximum gamma correction curve. The gray-level interpolation block may perform an interpolation related to gray-levels based on the gamma correction values of the predetermined minimum gamma correction curve and the gamma correction values of the predetermined maximum gamma correction curve. Since these are described above, details thereof will not be repeated.

The timing control unit 540 may generate a plurality of control signals CTL1, CTL2, CTL3, CTL4, CTL5, and CTL6 to provide the control signals CTL1, CTL2, CTL3, CTL4, CTL5, and CTL6 to the scan driving unit 520, the data driving unit 530, the control signal generating unit 550, the power unit 560, the high-power voltage calculation unit 570, and the gamma correction unit 580. Thus, the timing control unit 540 may control the scan driving unit 520, the data driving unit 530, the control signal generating unit 550, the power unit 560, the high-power voltage calculation unit 570, and the gamma correction unit 580. Thus, respective pixel circuits of the pixel unit 510 may operate based on the high-power voltage ELVDD, the low-power voltage ELVSS, the scan signal, the data signal, the emission control signal CSL, etc.

The organic light emitting display device 500 having the gamma correction unit 580 may help increase a change margin of the high-power voltage supplied in the emission period while helping to prevent color changes of the input image due to changes of the high-power voltage of the emission period when the high-power voltage of the emission period is changed. Therefore, the organic light emitting display device 500 having the gamma correction unit 580 may significantly reduce power consumption. In some example embodiments, the scan driving unit 520, the data driving unit 530, the timing control unit 540, the control signal generating unit 550, the power unit 560, the high-power voltage calculation unit 570, and the gamma correction unit 580 may be implemented by one integrated circuit (IC) chip. In addition, the high-power voltage calculation unit 570 and/or the gamma correction unit 580 may be implemented within the timing control unit 540.

Figure 10:
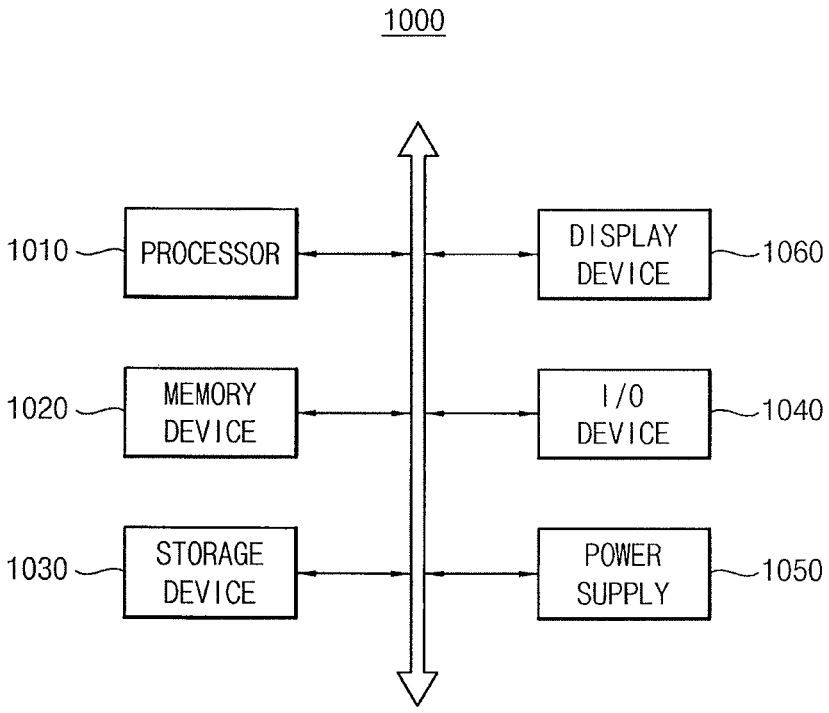
FIG. 10 is a block diagram illustrating an electronic device having an organic light emitting display device of FIG. 9.

FIG. 10 is a block diagram illustrating an electronic device having an organic light emitting display device of FIG. 9.

Referring to FIG. 10, the electronic device 1000 may include a processor 1010, a memory device 1020, a storage device 1030, an input/output (I/O) device 1040, a power supply 1050, and an organic light emitting display device 1060. Here, the organic light emitting display device 1060 may correspond to the organic light emitting display device 500 of FIG. 9. In addition, the electronic device 1000 may further include a plurality of ports for communicating with a video card, a sound card, a memory card, a universal serial bus (USB) device, other electronic devices, etc.

The processor 1010 may perform various computing functions. The processor 1010 may be a micro processor, a central processing unit (CPU), etc. The processor 1010 may be coupled to other components via an address bus, a control bus, a data bus, etc. Further, the processor 1010 may be coupled to an extended bus such as a peripheral component interconnection (PCI) bus. The memory device 1020 may store data for operations of the electronic device 1000. For example, the memory device 1020 may include a non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or a volatile memory device such as a dynamic random access memory (DRAM) device, a static random access memory (SRAM) device, a mobile DRAM device, etc. The storage device 1030 may be a solid state drive (SSD) device, a hard disk drive (HDD) device, a CD-ROM device, etc.

The I/O device 1040 may be an input device such as a keyboard, a keypad, a touchpad, a touch-screen, a mouse, etc, and an output device such as a printer, a speaker, etc. In some example embodiments, the organic light emitting display device 1060 may be included in the I/O device 1040. The power supply 1050 may provide power for operations of the electronic device 1000. The organic light emitting display device 1060 may communicate with other components via the buses or other communication links. The organic light emitting display device 1060 may employ a simultaneous emission driving technique as described above. The organic light emitting display device 1060 may include a pixel unit, a scan driving unit, a data driving unit, a timing control unit, a control signal generating unit, a power unit, a high-power voltage calculation unit, and a gamma correction unit. Here, the gamma correction unit may help prevent color changes of an input image due to changes of a high-power voltage of an emission period of the organic light emitting display device 1060 by performing a gamma correction based on a gamma correction curve generated by reflecting changes of the high-power voltage of the emission period when the high-power voltage of the emission period is changed. As a result, the organic light emitting display device 1060 may help increase a change margin of the high-power voltage supplied in the emission period, and may significantly reduce power consumption.

Embodiments may be applied to a system having an organic light emitting display device. For example, embodiments may be applied to a television, a computer monitor, a laptop, a digital camera, a cellular phone, a smart phone, a smart pad, a personal digital assistant (PDA), a portable multimedia player (PMP), an MP3 player, a navigation system, a game console, a video phone, etc.

By way of summation and review, a simultaneous emission driving technique may cyclically change power voltages (i.e., voltage levels of the power voltages ELVDD and ELVSS) according to a frame operation period. In addition, the simultaneous emission driving technique may set the high-power voltage (i.e., ELVDD) of an emission period to be different from the high-power voltage of a non-emission period in order to reduce power consumption. For example, the simultaneous emission driving technique may detect a gray-level range of an input image data, may decrease the high-power voltage of the emission period if the gray-level range is relatively narrow, and may increase the high-power voltage of the emission period if the gray-level range is relatively wide. For example, assuming that a total gray-level range of the input image data is between 0 and 255, and that a maximum voltage of the high-power voltage is 15V, a high-power voltage of 10V may be supplied in the emission period if the gray-level range of the input image data is between 0 and 140, and a high-power voltage of 15V may be supplied in the emission period if the gray-level range of the input image data is between 0 and 255. Here, compared to when the high-power voltage of 15V is supplied in the emission period, a phenomenon in which a color of an input image becomes yellowish may occur when the high-power voltage of 10V is supplied in the emission period. Color changes of the input image may be caused if the high-power voltage of the emission period greatly decreases. Thus, a change margin of the high-power voltage supplied in the emission period may be relatively small (i.e., narrow change margin). For example, when the total gray-level range of the input image data is between 0 and 255, and the maximum voltage of the high-power voltage is 15V, a user may notice color changes of the input image if the high-power voltage decreases below 13.5V.

As described above, embodiments relate to a method of generating gamma correction curves for an organic light emitting display device employing a simultaneous emission driving technique, a gamma correction unit, and an organic light emitting display device having the gamma correction unit. Some example embodiments provide a method of generating gamma correction curves for an organic light emitting display device employing a simultaneous emission driving technique while helping prevent color changes of an input image due to changes of a high-power voltage of an emission period. Some example embodiments provide a gamma correction unit for an organic light emitting display device employing a simultaneous emission driving technique, the gamma correction unit helping to prevent color changes of an input image due to changes of a high-power voltage of an emission period. Some example embodiments provide an organic light emitting display device having the gamma correction unit that helps increasing a change margin of a high-power voltage supplied in an emission period.

A method of generating gamma correction curves according to example embodiments may generate a gamma correction curve by reflecting changes of a high-power voltage of an emission period when the high-power voltage of the emission period is changed in an organic light emitting display device employing a simultaneous emission driving technique. In addition, a gamma correction unit according to example embodiments may help prevent color changes of an input image due to changes of a high-power voltage of an emission period by performing a gamma correction based on a gamma correction curve generated by reflecting the changes of the high-power voltage of the emission period when the high-power voltage of the emission period is changed in an organic light emitting display device employing a simultaneous emission driving technique. Further, an organic light emitting display device having the gamma correction unit according to example embodiments may help increase a change margin of a high-power voltage supplied in an emission period by preventing color changes of an input image due to changes of the high-power voltage of the emission period when the high-power voltage of the emission period is changed. As a result, the organic light emitting display device may significantly reduce power consumption.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A method of gamma correction for an organic light emitting display device, the method comprising:

calculating a high-power voltage to be supplied in an emission period of the organic light emitting display device based on a gray-level range of an input image data for each frame;

generating a gamma correction curve for the calculated high-power voltage based on a predetermined minimum gamma correction curve and a predetermined maximum gamma correction curve;

performing a gamma correction on image data based on the gamma correction curve to generate gamma-corrected image data; and displaying the gamma-corrected image data on the organic light emitting display device, wherein gamma correction values of the gamma correction curve decrease as the calculated high-power voltage increases, and the gamma correction values of the gamma correction curve increase as the calculated high-power voltage decreases, wherein the input image data includes a red color data, a green color data, and a blue color data, and the calculated high-power voltage is determined based on a greatest maximum gray-level among a maximum gray-level of the red color data, a maximum gray-level of the green color data, and a maximum gray-level of the blue color data.

2. The method as claimed in claim 1, wherein the gamma correction curve corresponds to the predetermined minimum gamma correction curve when the calculated high-power voltage corresponds to a predetermined maximum high-power voltage, and the gamma correction curve corresponds to the predetermined maximum gamma correction curve when the calculated high-power voltage corresponds to a predetermined minimum high-power voltage.

3. The method as claimed in claim 1, wherein generating the gamma correction curve includes:

providing gamma correction values of the predetermined minimum gamma correction curve;

providing gamma correction values of the predetermined maximum gamma correction curve; and calculating gamma correction values of the gamma correction curve by performing an interpolation based on the gamma correction values of the predetermined minimum gamma correction curve and the gamma correction values of the predetermined maximum gamma correction curve.

4. The method as claimed in claim 3, wherein the gamma correction values of the gamma correction curve are calculated by performing an interpolation related to voltages, and then by performing an interpolation related to gray-levels.

5. The method as claimed in claim 3, wherein the interpolation corresponds to a linear interpolation or a non-linear interpolation.

6. A gamma correction unit, comprising:

a pre-processing block configured to generate a pre-processing image data by performing a pre-processing on an input image data for each frame;

a gamma correction curve generating block configured to generate a gamma correction curve for a calculated high-power voltage based on a predetermined minimum gamma correction curve and a predetermined maximum gamma correction curve, the calculated high-power voltage being supplied in an emission period of an organic light emitting display device; and a post-processing block configured to generate a post-processing image data to be displayed on a display panel by performing a gamma correction on the pre-processing image data based on the gamma correction curve, wherein gamma correction values of the gamma correction curve decrease as the calculated high-power voltage increases, and the gamma correction values of the gamma correction curve increase as the calculated high-power voltage decreases, wherein the input image data includes a red color data, a green color data, and a blue color data, and the calculated high-power voltage is determined based on a greatest maximum gray-level among a maximum gray-level of the red color data, a maximum gray-level of the green color data, and a maximum gray-level of the blue color data.

7. The unit as claimed in claim 6, wherein the gamma correction curve corresponds to the predetermined minimum gamma correction curve when the calculated high-power voltage corresponds to a predetermined maximum high-power voltage, and the gamma correction curve corresponds to the predetermined maximum gamma correction curve when the calculated high-power voltage corresponds to a predetermined minimum high-power voltage.

8. The unit as claimed in claim 6, wherein the gamma correction curve generating block includes:

a look-up table configured to store gamma correction values of the predetermined minimum gamma correction curve and gamma correction values of the predetermined maximum gamma correction curve;

a voltage interpolation block configured to perform an interpolation related to voltages based on the gamma correction values of the predetermined minimum gamma correction curve and the gamma correction values of the predetermined maximum gamma correction curve; and a gray-level interpolation block configured to perform an interpolation related to gray-levels based on the gamma correction values of the predetermined minimum gamma correction curve and the gamma correction values of the predetermined maximum gamma correction curve.

9. The unit as claimed in claim 8, wherein at least one of the interpolation performed by the voltage interpolation block and the interpolation performed by the gray-level interpolation block corresponds to a linear interpolation or a non-linear interpolation.

10. An organic light emitting display device, comprising:

a pixel unit having a plurality of pixel circuits;

a scan driving unit configured to provide a scan signal to the pixel circuits;

a data driving unit configured to provide a data signal to the pixel circuits;

a control signal generating unit configured to provide an emission control signal to the pixel circuits;

a high-power voltage calculation unit configured to calculate a high-power voltage to be supplied in an emission period based on a gray-level range of an input image data for each frame;

a gamma correction unit configured to generate a gamma correction curve for the calculated high-power voltage based on a predetermined minimum gamma correction curve and a predetermined maximum gamma correction curve, and to provide a post-processing image data corresponding to the data signal based on the gamma correction curve to the data driving unit;

a power unit configured to provide the calculated high-power voltage and a low-power voltage to the pixel circuits; and a timing control unit configured to control the scan driving unit, the data driving unit, the control signal generating unit, the high-power voltage calculation unit, the gamma correction unit, and the power unit.

11. The device as claimed in claim 10, wherein the high-power voltage calculation unit and the gamma correction unit are implemented within the timing control unit.

12. The device as claimed in claim 10, wherein the gamma correction unit includes:

a pre-processing block configured to generate a pre-processing image data by performing a pre-processing on the input image data for each frame;

a gamma correction curve generating block configured to generate the gamma correction curve by performing an interpolation based on the predetermined minimum gamma correction curve and the predetermined maximum gamma correction curve; and a post-processing block configured to generate the post-processing image data by performing a gamma correction on the pre-processing image data based on the gamma correction curve.

13. The device as claimed in claim 12, wherein:

the input image data includes a red color data, a green color data, and a blue color data, and the calculated high-power voltage is determined based on a greatest maximum gray-level among a maximum gray-level of the red color data, a maximum gray-level of the green color data, and a maximum gray-level of the blue color data.

14. The device as claimed in claim 13, wherein gamma correction values of the gamma correction curve decrease as the calculated high-power voltage increases, and the gamma correction values of the gamma correction curve increase as the calculated high-power voltage decreases.

15. The device as claimed in claim 14, wherein the gamma correction curve corresponds to the predetermined minimum gamma correction curve when the calculated high-power voltage corresponds to a predetermined maximum high-power voltage, and the gamma correction curve corresponds to the predetermined maximum gamma correction curve when the calculated high-power voltage corresponds to a predetermined minimum high-power voltage.

16. The device as claimed in claim 12, wherein the gamma correction curve generating block includes:

a look-up table configured to store gamma correction values of the predetermined minimum gamma correction curve and gamma correction values of the predetermined maximum gamma correction curve;

a voltage interpolation block configured to perform an interpolation related to voltages based on the gamma correction values of the predetermined minimum gamma correction curve and the gamma correction values of the predetermined maximum gamma correction curve; and a gray-level interpolation block configured to perform an interpolation related to gray-levels based on the gamma correction values of the predetermined minimum gamma correction curve and the gamma correction values of the predetermined maximum gamma correction curve.

* * * * *